US005640070A

United States Patent [19]

Wolf

[11] Patent Number: 5,640,070

[45] Date of Patent: Jun. 17, 1997

[54] ELECTRONIC FLASH APPARATUS WITH A PROTECTIVE CIRCUIT WHICH LIMITS HEATING

[75] Inventor: Michael Wolf, Oberasbach, Germany

[73] Assignee: Metz-Werke GmbH & Co. KG, Fuerth, Germany

[21] Appl. No.: 534,456

[22] Filed: Sep. 27, 1995

[30] Foreign Application Priority Data

Sep. 29, 1994 [DE] Germany ..... 9415646 U

[51] Int. Cl.[6] ..... H05B 37/00

[52] U.S. Cl. ..... 315/241 P; 315/240; 315/158; 315/159; 315/119

[58] Field of Search ..... 315/241 P, 241 S, 315/158, 50, 129, 240, 159, 119; 354/458, 459, 464, 465

[56] References Cited

U.S. PATENT DOCUMENTS

| | | | |
|---|---|---|---|
| 4,001,639 | 1/1977 | Biber | 315/241 P |
| 4,091,308 | 5/1978 | Schneider | 315/151 |
| 4,228,381 | 10/1980 | Hasegawa | 315/151 |
| 4,240,008 | 12/1980 | Numata | 315/151 |
| 4,302,707 | 11/1981 | Hattori | 315/241 P |
| 4,303,849 | 12/1981 | Goede et al. | 315/241 P |
| 4,951,080 | 8/1990 | Sakamoto et al. | 354/414 |
| 5,023,470 | 6/1991 | Onozuka et al. | 315/241 P X |

FOREIGN PATENT DOCUMENTS 1170070 5/1964 Germany .

*Primary Examiner*—Robert Pascal
*Assistant Examiner*—Haissa Philogene
*Attorney, Agent, or Firm*—Spencer & Frank

[57] ABSTRACT

In an electronic flash apparatus having a flash tube (2) which is disposed inside a reflector (3), having a storage capacitor (5) which can be discharged via the flash tube having a d.c. voltage converter (7) which is fed by a d.c. voltage source, preferably a battery (6), and by means of which the storage capacitor (5) can be recharged to its operating voltage following each discharge, and having a control circuit (8) which switches the d.c. voltage converter (7) on or off as a function of the voltage at the storage capacitor (5), overheating of the reflector (3) and/or its front elements (4) is prevented by a protective circuit (12) which influences the flash light emission in such a way that the temperature of the reflector (3) and/or its front elements (4) does not exceed a predetermined maximum value.

13 Claims, 1 Drawing Sheet

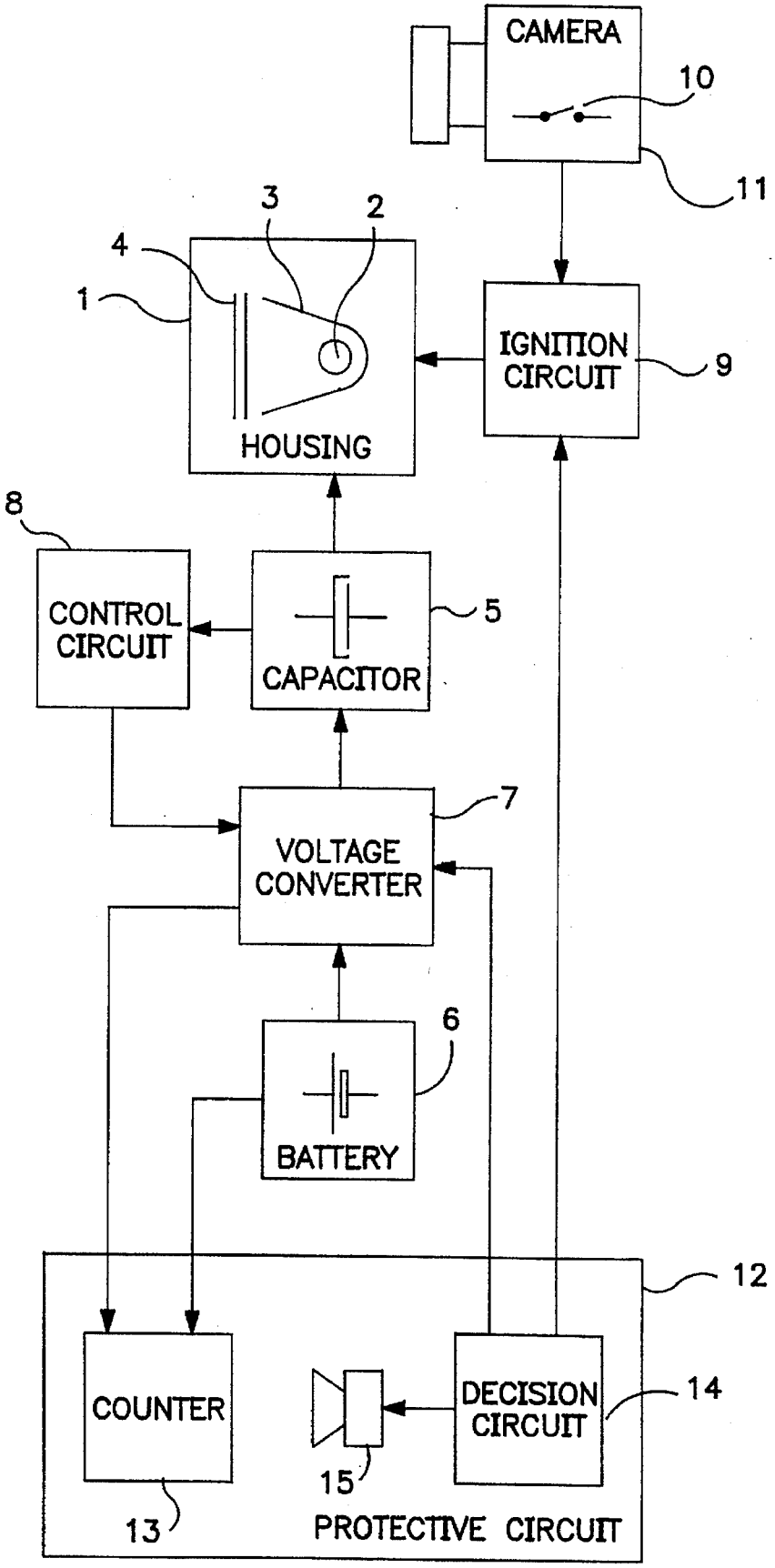
CAMERA
10
11
3
2
4
1
IGNITION CIRCUIT
9
HOUSING
8
CONTROL CIRCUIT
CAPACITOR
5
7
VOLTAGE CONVERTER
6
BATTERY
12
COUNTER
DECISION CIRCUIT
14
15
13
PROTECTIVE CIRCUIT

ELECTRONIC FLASH APPARATUS WITH A PROTECTIVE CIRCUIT WHICH LIMITS HEATING

BACKGROUND OF THE INVENTION

The invention relates to an electronic flash apparatus having a flash tube which is disposed inside a reflector, having a storage capacitor which can be discharged via the flash tube, having a d.c. voltage converter which is fed by a d.c. voltage source, preferably a battery, and by means of which the storage capacitor can be recharged to its operating voltage following each discharge, and having a control circuit which turns the d.c. voltage converter on or off as a function of the voltage at the storage capacitor.

These kinds of electronic flash apparatuses are known from, for example, DE-PS 11 70 070. The control circuit of this document always switches the d.c. voltage converter on when the voltage at the storage capacitor falls below a specific minimum voltage. If the photographer triggers several flashes in quick succession, it can occur that heat-sensitive parts of the electronic flash apparatus, for example the reflector and its front optical disks or elements are damaged by the heat released by the flash tube, particularly in modern electronic flash apparatuses having a high guide number and/or having a zoom reflector, in which the distance between the flash tube and the optical elements is very small.

SUMMARY OF THE INVENTION

The object of the invention is to improve an electronic flash apparatus of the type mentioned at the outset in such a way that a thermal overload of the heat-sensitive parts of the reflector is prevented and the reflector has the same spatial configuration, with its flash tube and front optical elements.

This object is accomplished by a protective circuit that influences the flash light emission in such a manner that the temperature of the reflector and/or its front elements does not exceed a predetermined maximum value. According to a first variation, it is provided that the protective circuit determines the course of the temperature over time by means of direct measurements at the reflector and/or its front elements.

According to an advantageous refinement of the invention, the protective circuit calculates the course of the temperature over time by approximation from the on and off periods of the d.c. voltage converter, taking into consideration the respective time constants for heating and cooling the reflector and/or its front elements.

According to a further embodiment of the invention, the protective circuit has a counter for measuring the on and off periods of the d.c. voltage converter; during the on period of the d.c. voltage converter, this counter takes into consideration the time constant for heating by means of a corresponding increase in the counter value, and the time constant for cooling by means of a corresponding reduction in the counter value during the off period of the d.c. voltage converter.

The on and off periods of the d.c. voltage converter are determined in a simple manner, with the aid of the counter, by means of monitoring of the current drain from the battery.

According to another variation, it is provided that a microcontroller, with the aid of appropriate software, takes over the task of the counter.

According to a further embodiment of the invention, the protective circuit influences the flash light emission by increasing the flash sequence time in that it prevents or delays the trigger of a further flash, or switches off the d.c. voltage converter for an appropriate time, or reduces its output, in which instance an acoustical and/or optical signal is simultaneously triggered.

The notable advantages attained with the invention are that an electronic flash apparatus with higher output and short flash sequence times is automatically protected from damage if this apparatus is operated at maximum output, and with the shortest flash sequence time, in excessively lengthy continuous operation.

BRIEF DESCRIPTION OF THE DRAWING

An embodiment of the invention is illustrated in the drawing figure and described in detail below.

DESCRIPTION OF THE PREFERRED EMBODIMENTS

The electronic flash apparatus of the invention includes a reflector housing 1 having a flash tube 2, which is disposed inside a reflector 3 whose front opening can be covered by optical front disks or elements 4, for example a lens system comprising Fresnel lenses and a protective lens. The electronic flash apparatus further includes a storage capacitor 5 which can be discharged via the flash tube 2, a d.c. voltage converter 7 which is fed by a battery 6 and by means of which the storage capacitor 5 can be recharged to its operating voltage following each discharge, and a control circuit 8 which switches the d.c. voltage converter 7 on or off as a function of the voltage at the storage capacitor 5.

An ignition circuit 9, which can be controlled by a synchronous contact or switch 10 disposed in a photocamera 11, is further provided for operation of the electronic flash apparatus. When the photocamera 11 is triggered, the synchronous contact or switch 10 is closed, and the ignition circuit 9 generates an ignition pulse that triggers the flash tube 2, so that the storage capacitor 5 discharges its charge, with a short but powerful discharge current, via the flash tube 2. This discharge current generates a flash light in the flash tube 2 that is radiated via the reflector 3 and the front elements 4 and, when the reflector 3 is properly oriented, illuminates the scene to be photographed with the photocamera 11.

Unfortunately, the discharge current not only generates light in the flash tube 2, but a large amount of heat as well; by means of both radiation and heat conduction, this light travels directly to the walls of the reflector 3 disposed in the immediate vicinity, and its front elements 4, and heats them. Because these parts are made of plastic—at least to some extent—which is known to be very sensitive to heat, the danger exists that they will become deformed or will even melt, thus becoming unusable.

To eliminate this danger, a protective circuit 12 is provided according to the invention; this circuit influences the flash light emission in such a way that the temperature of the reflector 3 and its front elements 4 does not exceed a predetermined maximum value. This can be the result of, for example, the determination of the course of the temperature over time by the protective circuit 12 through direct measurements at the reflector 3 and its front elements 4.

The protective circuit 12 can, however, also determine the course of the temperature over time by approximation from the on and off periods of the d.c. voltage converter 7, taking into consideration the respective time constants for heating and cooling the reflector 3 and its front elements 4; a counter 13 is provided for measuring the on and off periods of the d.c. voltage converter 7, taking into consideration the time constant for heating by means of a corresponding increase in the counter value during the on period and the time constant for cooling by means of a corresponding decrease in the counter value during the off period.

The on and off periods of the d.c. voltage converter 7 are determined in a simple manner, with the aid of the counter 13, by means of monitoring of the current drain from the battery 6. Instead of the counter 13, a microcontroller can also be provided which, with the aid of appropriate software, takes over the task of the counter 13.

If, according to the above-described measuring method, it is detected that a certain temperature has been exceeded, the protective circuit 12 prevents a further rise in temperature. This can be effected in accordance with different methods, namely in that the protective circuit 12 increases the flash sequence time by preventing or delaying the ignition of a further flash, or switching off the d.c. voltage converter 7 during an appropriate time, or reducing its output, in which instance a decision circuit 14 decides which of the methods listed is to be applied based on the measurement results.

An acoustical or optical signal emitter 15 indicates to the photographer that the maximum permissible temperature has been reached.

With the above-described measures, the electronic flash apparatus is automatically protected from damage if it is operated at excessive output, and with the shortest flash sequence times, in excessively lengthy continuous operation.

What is claim is:

1. An electronic flash apparatus for use with a d.c. voltage source, comprising:

a reflector;

a flash tube inside the reflector;

an optical element in front of the reflector;

a storage capacitor which can be discharged via the flash tube to emit a light flash;

a d.c. voltage converter to charge the storage capacitor, the d.c. voltage converter being fed by the d.c. voltage source; and protective circuit means for influencing the light flash emission so that the temperature of at least one of the reflector and the optical element does not exceed a predetermined maximum value, the protective circuit means further including means for emitting at least one of an acoustical and an optical warning signal when the predetermined maximum value of the temperature is reached.

2. The electronic flash apparatus according to claim 1, wherein the protective circuit means comprises means for determining the course of the temperature over time by direct measurements at at least one of the reflector and the optional element.

3. The electronic flash apparatus according to claim 1, wherein the protective circuit means influences the light flash emission by increasing a flash sequence time.

4. The electronic flash apparatus according to claim 3, wherein the protective circuit means comprises means for preventing emission of a further flash in order to increase the flash sequence time.

5. The electronic flash apparatus according to claim 3, wherein the protective circuit means comprises means for delaying emission of a further flash in order to increase the flash sequence time.

6. The electronic flash apparatus according to claim 1, further comprising a control circuit which switches the d.c. voltage covoltage converter on or off as a function of the voltage at the storage capacitor.

7. An electronic flash apparatus for use with a d.c. voltage source, comprising:

a reflector;

a flash tube inside the reflector;

an optical element in front of the reflector;

a storage capacitor which can be discharged via the flash tube to emit a light flash;

a d.c. voltage converter to charge the storage capacitor, the d.c. voltage converter being fed by the d.c. voltage source;

a control circuit which switches the d.c. voltage converter on or off as a function of the voltage at the storage capacitor; and protective circuit means for influencing the light flash emission, by increasing a flash sequence time, so that the temperature of at least one of the reflector and the optical element does not exceed a predetermined maximum value, the protective circuit means including means for switching off the d.c. voltage converter for a time in order to increase the flash sequence time.

8. An electronic flash apparatus for use with a d.c. voltage source, comprising:

a reflector having a time constant for heating and cooling;

a flash tube inside the reflector;

an optical element in front of the reflector, the optical element having a time constant for heating and cooling;

a storage capacitor which can be discharged via the flash tube to emit a light flash;

a d.c. voltage converter to charge the storage capacitor, the d.c. voltage converter being fed by the d.c. voltage source;

a control circuit which switches the d.c. voltage converter on or off as a function of the voltage at the storage capacitor; and protective circuit means for influencing the light flash emission so that the temperature of at least one of the reflector and the optical element does not exceed a predetermined maximum value, the protective circuit means including means for calculating the course of the temperature over time by approximation from the on and off periods of the d.c. voltage converter, taking into consideration the respective time constants for heating and cooling at least one of the reflector and the optical element.

9. The electronic flash apparatus according to claim 8, wherein the protective circuit means includes a counter which measures the on and off periods of the d.c. voltage converter, taking into consideration the time constant for heating by means of a corresponding increase in the counter value, and the time constant for cooling through a corresponding reduction in the counter value during the off period of the d.c. voltage converter.

10. The electronic flash apparatus according to claim 9, wherein the on and off periods of the d.c. voltage converter are determined by measuring the times of current flux and the times without current flux between the d.c. voltage source and the d.c. voltage converter.

11. The electronic flash apparatus according to claim 8, wherein the protective circuit means includes a programmed microcontroller.

12. The electronic flash apparatus according to claim 8, wherein the d.c. power source comprises a battery.

13. An electronic flash apparatus for use with a d.c. voltage source, comprising:

a reflector;

a flash tube inside the reflector;

an optical element in front of the reflector;

a storage capacitor which can be discharged via the flash tube to emit a light flash;

a d.c. voltage converter to charge the storage capacitor, the d.c. voltage converter being fed by the d.c. voltage source and having an output; and protective circuit means for influencing the light flash emission, by influencing a flash sequence time, so that the temperature of at least one of the reflector and the optical element does not exceed a predetermined maximum value, the protective circuit means including means for decreasing the output of the d.c. voltage converter for a time in order to increase the flash sequence time.

* * * * *